US005575058A

United States Patent [19]

Nakamura et al.

[11] Patent Number: 5,575,058

[45] Date of Patent: Nov. 19, 1996

[54] CONNECTOR HOUSING SUPPLYING DEVICE

[75] Inventors: Tokuji Nakamura; Kenichi Taniguchi; Hiroki Shuto; Yoshinobu Ohta, all of Yokkaichi, Japan

[73] Assignee: Sumitomo Wiring Systems, Ltd., Japan

[21] Appl. No.: 393,069

[22] Filed: Feb. 23, 1995

[30] Foreign Application Priority Data

Feb. 23, 1994 [JP] Japan ..... 6-025199

[51] Int. Cl.[6] ..... H01R 43/00

[52] U.S. Cl. ..... 29/748; 29/33 M; 29/749; 29/760

[58] Field of Search ..... 29/33 M, 748, 29/749, 759, 760, 794, 786; 198/409

[56] References Cited

U.S. PATENT DOCUMENTS

| | | | |
|---|---|---|---|
| 4,675,995 | 6/1987 | Anderson | 29/749 X |
| 4,680,841 | 7/1987 | Schneider et al. | 29/749 X |
| 4,729,152 | 3/1988 | Hammond et al. | 29/33 M |
| 4,838,407 | 6/1989 | Komuro | 29/759 X |
| 4,970,778 | 11/1990 | den Otter | 29/749 |

FOREIGN PATENT DOCUMENTS

| | | | |
|---|---|---|---|
| 3821432 | 1/1989 | Germany | 29/748 |
| 61-294715 | 12/1986 | Japan | 29/748 |
| 63-174244 | 7/1988 | Japan . | |
| 63-195984 | 8/1988 | Japan | 29/748 |
| 63-314716 | 12/1988 | Japan . | |

*Primary Examiner*—Peter Vo

*Attorney, Agent, or Firm*—Anthony J. Casella; Gerald E. Hespos

[57] ABSTRACT

A pallet 71 is provided to array connector housings C side by side in correspondence with the side by side alignment of an aligning unit A in a plurality of rows. A conveying unit 74 includes a plurality of actuators 74*a* for holding a row of connector housings C arrayed side by side on the pallet 71. Conveyors 74*b*, 74*c* and 74*d* are further provided to carry actuators 74 *a* integrally to the aligning unit A.

In changing the combination of the connector housings to be handled, only the pallet needs to be replaced without necessitating a change in a conveying unit. Accordingly, the conveying unit 74 can be widely used for a variety of connector housings, and labor and time required for replacement can be reduced. Further, installation can be of smaller size compared to the prior art guide member for guiding the connector housings C in sliding contact therewith, leading to a considerable reduction in installation cost.

11 Claims, 5 Drawing Sheets

CONNECTOR HOUSING SUPPLYING DEVICE

BACKGROUND OF THE INVENTION

1. Field of the Invention

The present invention relates to a connector housing supplying device and, more particularly to a connector housing supplying device optimal for automatically supplying connector housings to a device for connecting electric wires with the connector housings.

2. Description of the Prior Art

A wiring harness mounted in an automotive vehicle or the like is, in general, an electric wiring system formed by bundling a plurality of electric wires cut into specified sizes. There is known a wire connecting device for connecting a multitude of electric wires with a plurality of kinds of connector housings as a device used to fabricate such a wiring harness (see, e.g., Japanese Unexamined Patent Publication No. 63, -174224).

Quite a few connector housing supplying devices have been proposed which automatically supply the connector housings to the wire connecting device (e.g., Japanese Unexamined Patent Publications Nos. 61-294715 , 63-195984 and 63-314716).

As disclosed in the Publication No. 61-294715, the connector housing supplying device is provided with an aligning unit (positioning means at the wire connecting side) for aligning connector housings in side-by-side relationship so that they can be easily connected with wires, a conveying unit for conveying the connector housings to the aligning unit, and a positioning unit (positioning means at the supplying side) for positioning and supplying the connector housings in correspondence with the alignment at the aligning unit. The connector housings are conveyed from the positioning unit to the aligning unit through a guide member.

If the connector housings are conveyed from the aligning unit to the positioning unit by the conveying unit as in the prior art, the next connector housings are positioned by the positioning unit during the wire connecting operation. Thus, a waiting period can be shortened compared to the case where the connector housings are directly supplied from a supply source to the aligning unit, thereby improving the working efficiency.

In recent years, the above-mentioned connector housing supplying devices have been required to have high working efficiency and wide use to handle a plurality of kinds of wiring harnesses. More specifically, wiring harnesses have different numbers of connectors and circuits depending upon the product incorporating them. The more complicated the wiring of the product incorporating the wiring system, the more kinds of connector housings are used. Thus, there is a demand for a connector housing supplying device which can be widely used to efficiently fabricate a variety of wiring harnesses.

In the prior art supplying device, the conveying unit conveys the connector housing by means of the guide member guiding the connector housings in sliding contact therewith. Accordingly, the design of the guide member needs to be changed each time the kind of the connector housings is changed. Thus, the supplying device cannot be widely used.

More specifically, it is necessary to accurately maintain the positions of the connector housings determined by the positioning unit when the connector housings are conveyed from the positioning unit to the aligning unit. The guide members need to be designed individually and specifically in conformity with the shape of the connector housings so that the posture of the connector housings does not change. Thus, in fabricating a variety of products each in small quantity, the conveying unit, particularly, the guide member needs to be changed each time the product is changed. This leads to a considerable amount of labour for replacement and consequently increases the production costs.

When the guide members are employed, more connector housings must be positioned side by side by the positioning unit, and a larger installation for arranging the guide members is required. This leads not only to a considerable increase in installation cost, but also to difficulty to provide a sufficient space.

In view of the problems residing in the prior art, it is an object of the invention to provide an inexpensive connector housing supplying device which can be widely used and replaced with reduced labor.

SUMMARY OF THE INVENTION

According to the invention, the connector housings to be supplied are arrayed in a plurality of rows on the pallet in correspondence with the side-by-side alignment of the aligning means. The arrayed connector housings are picked up by the actuators, thereby maintaining the side-by-side alignment of the connector housings. The connector housings, picked up by the actuators, are conveyed to the aligning means by the conveying means while being arrayed side by side.

As described above, in the construction according to the invention, connector housings arrayed side by side on a pallet are transported, preferably, while being held by actuators. Accordingly, in changing the combination of the connector housings to be handled, only the pallet needs to be replaced without necessitating a change in conveying means. Thus, remarkable effects can be obtained: the conveying means can be widely used for a variety of connector housings, and labor and time required for replacement can be reduced.

Further, employment of the pallet for arranging connector housings side-by-side in a plurality of rows in the above construction facilitates conveyance of connector housings, preferably, by means of the actuators. As a result, installation can be of smaller size compared to the prior art guide member for guiding the connector housings in sliding contact therewith, leading to a considerable reduction in installation cost.

In a further preferred embodiment of the invention, the connector housing supplying device further comprises a positioning unit for receiving the connector housings to be supplied to the aligning means from the actuators and for positioning them, in particular corresponding surfaces of the connector housings, at positions of the same reference plane or level, wherein the actuators picked up the connector housings positioned by the positioning unit again and transports them afterwards to the aligning means.

In a preferred embodiment of the invention, conveying means causes the actuators to convey the connector housings to a positioning unit to be located at positions of the same reference level, in particular to position corresponding surfaces of the housings at positions, so as to define a reference plane, before conveying them to the aligning means. Thus, connector housings of different sizes can be supplied during one conveyance.

According to a preferred embodiment of the invention, the positioning unit supplies the connector housings to be conveyed to the aligning means after positioning them at the same reference level or plane.

BRIEF DESCRIPTION OF THE DRAWINGS

Hereafter, one preferred embodiment of the invention is described in detail with reference to the accompanying drawings, in which.

DETAILED DESCRIPTION OF THE PREFERRED EMBODIMENT

Figure 1:
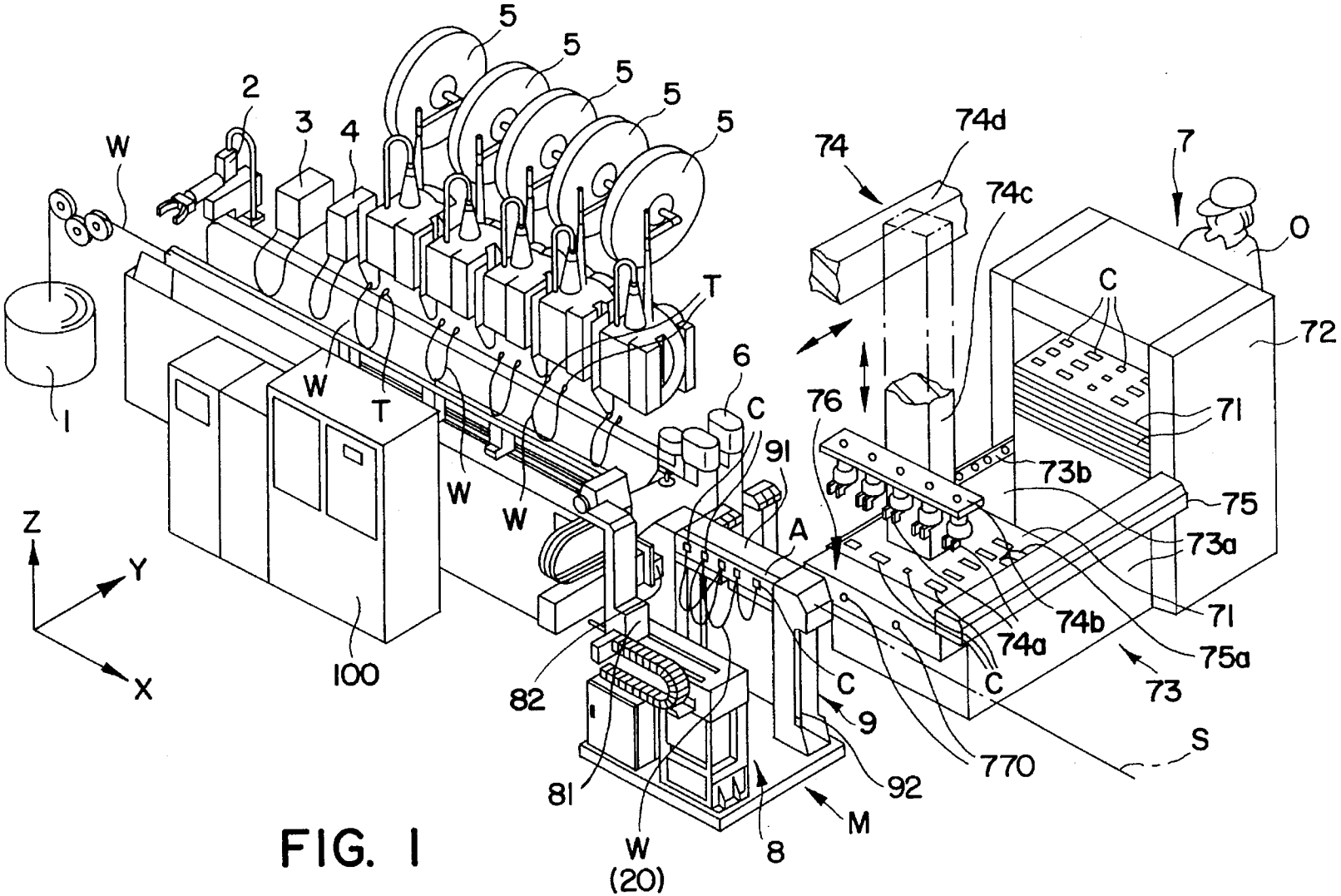
FIG. 1 is a schematic perspective view of a wire assembly producing apparatus incorporating a connector housing supplying device as an embodiment of the invention.

With reference to FIG. 1, the apparatus according to this embodiment is provided with a cutting device 2, a conveying device (not shown), a peeling device 3, a peeling detector 4, terminal cramping devices 5, and a wire transfer device 6. Cutting device 2 draws out insulated electric wire W from a winding 1, cuts drawn wire W into a specified length, and holds the both ends of the cut wire W so that it hangs downward in U-shape. The conveying device conveys wires W cut by cutting device 2 one after another while holding the both ends thereof. Peeling device 3 peels off the insulation of the ends of each wire W conveyed by the conveying device. Detector 4 detects whether or not the peeling has been properly performed. Cramping devices 5 selectively cramp a plurality of terminals T on the peeled portions of each wire W. Transfer device 6 rotates wire W on which terminals T are cramped while holding the both ends thereof.

The apparatus is further provided with a wire connecting device M for inserting terminals T of wire W received from wire transfer device 6 into predetermined connector housings C. A connector housing supplying device of this embodiment is adapted to supply connector housings C to connecting device M. In the description below, a direction in parallel with a direction of transport of wires denotes an X-direction, a direction perpendicular to the X-direction on a horizontal plane a Y-direction and a direction perpendicular to the X- and Y-directions on a vertical plane a Z-direction.

Figure 2:
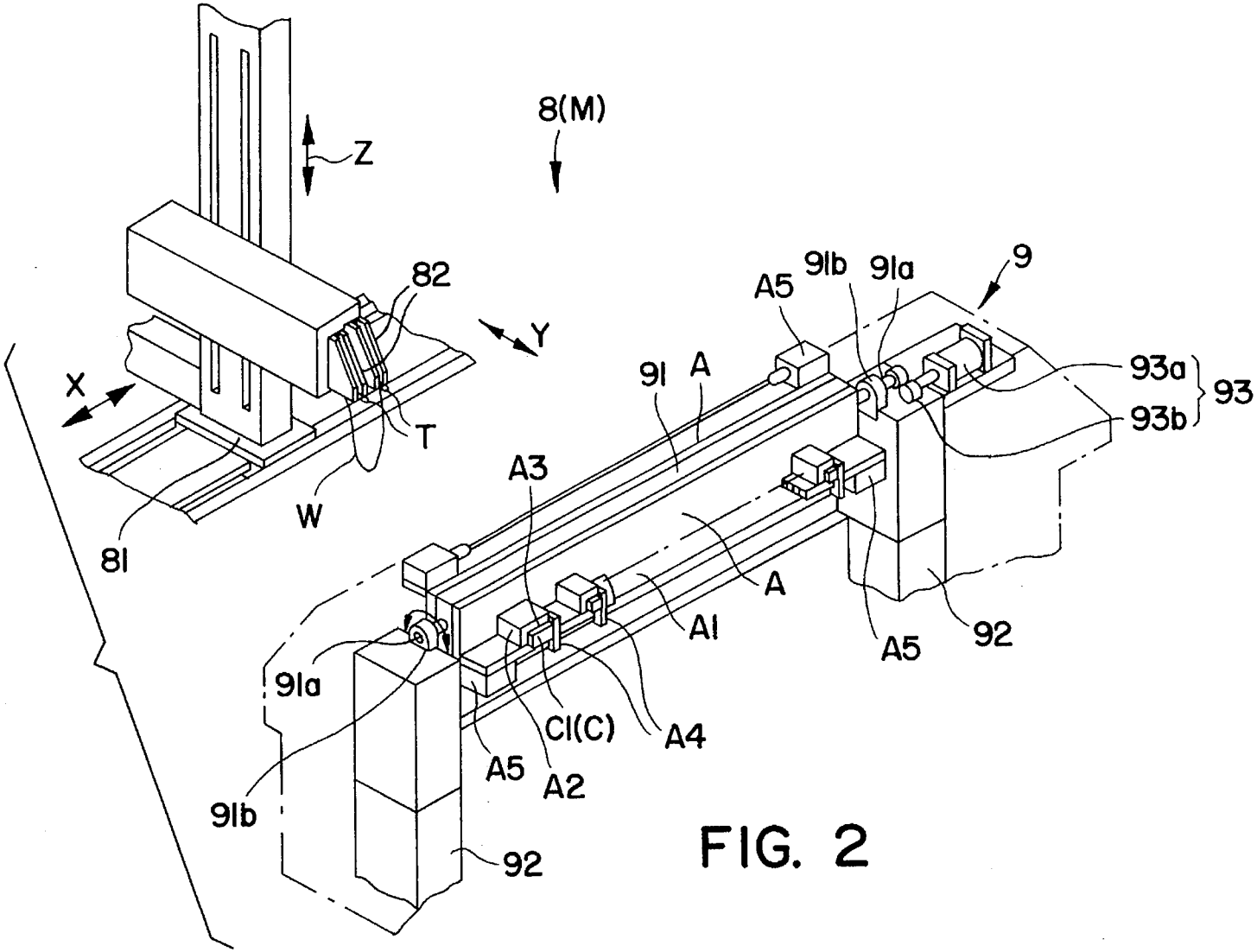
FIG. 2 is a schematic perspective view of an essential portion of a wire connecting device in the producing apparatus.

With reference to FIGS. 1 and 2, connecting device M is provided with a terminal inserting device 8 for receiving wire W from wire transfer device 6 and inserting terminals T into predetermined connector housings C. A supplying device 7 is provided with a housing holding device 9 for holding a plurality of connector housings C to be supplied to terminal inserting device 8.

Terminal inserting device 8 includes a movable table 81 reciprocally movable along the X-direction in FIG. 2 and a terminal inserting head 82 which is supported on a movable table 81 and movable along the Y- and Z-directions in FIG. 2. Head 82 also moves in the Y-direction while holding the both ends of wire W, thereby inserting terminals T of wire W into connector housings.

Holding device 9 is provided with housing holding plates A as an aligning unit (positioning means at the wire connecting side), a mount member 91 on which holding plates A are mounted, support members 92 supporting mount member 91 rotatably about a horizontal axis S parallel with the X-direction, and a drive device for rotating mount member 91 about horizontal axis S by 180° at a specified timing.

Figure 3:
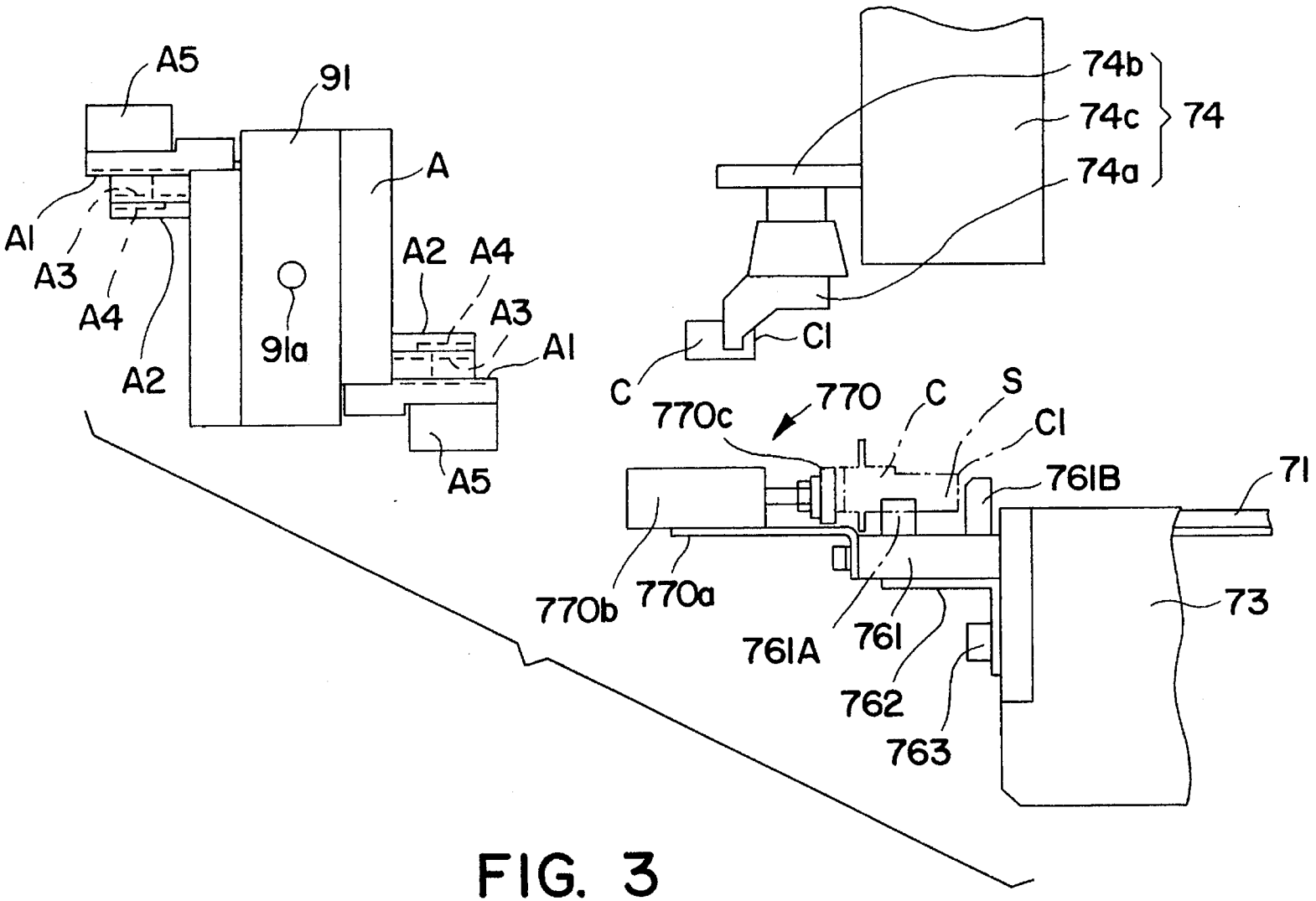
FIG. 3 is a schematic elevation showing a state where connector housings are supplied to the wire connecting device.

Holding plates A are each adapted to set a plurality of connector housings C at specified intervals in parallel with the horizontal axis X. As shown in FIGS. 2 and 3, each holding plate A includes a plate member A1 for placing connector housings C thereon and positioning gadgets A2 for positioning connector housing C in cooperation with plate member A1. Plate member A1 and positioning gadgets A2 define insertion openings A3 through which corresponding connector housings C can be inserted. Connector housings C are positioned at corresponding insertion openings A3. Plate member A1 is also provided with locking gadgets A4 for locking positioned connector housings C. Locking gadgets A4 are driven by a cylinder A5 mounted at the side of plate member A1 opposite to gadgets A4.

Mount member 91 is a member in the form of a rectangular pillar extending in the X-direction. Mount member 91 has a surface facing to terminal inserting device 8 in the Y-direction and another surface facing to the reverse direction. A holding plate A is detachably mounted and positioned on each of the above two surfaces by means of an unillustrated knock pin or like positioning member.

Mount member 91 carries support shaft 91*a* extending in the X-direction and projecting from opposite end surfaces thereof and is rotatably supported by support members 92 by way of support shaft 91*a* and bearings 91*b* for supporting support shaft 91*a* .

A pair of support members 92 are opposed to each other at a specified distance in the X-direction and mount member 91 is disposed between these support members 92.

One of support members 92 is provided internally with a driving device 93. Driving device 93 transmits a rotational force of a rotary actuator 93*a* to support shaft 91*a* of mount member 91 by means of gear mechanism 93*b* to thereby rotate mount member 91 by 180° each time. Mount member 91 is automatically rotated upon completion of a terminal inserting step. Each time mount member 91 is rotated by 180°, it is positioned by means of a knock pin or like positioning member.

Supplying device 7 of this embodiment employs pallet 71 (positioning means at the supplying side) each adapted to carry a multitude of connector housings C.

Figure 4B:
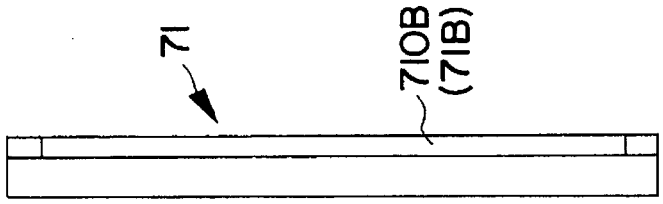
FIG. 4B is an elevation thereof.
Figure 4A:
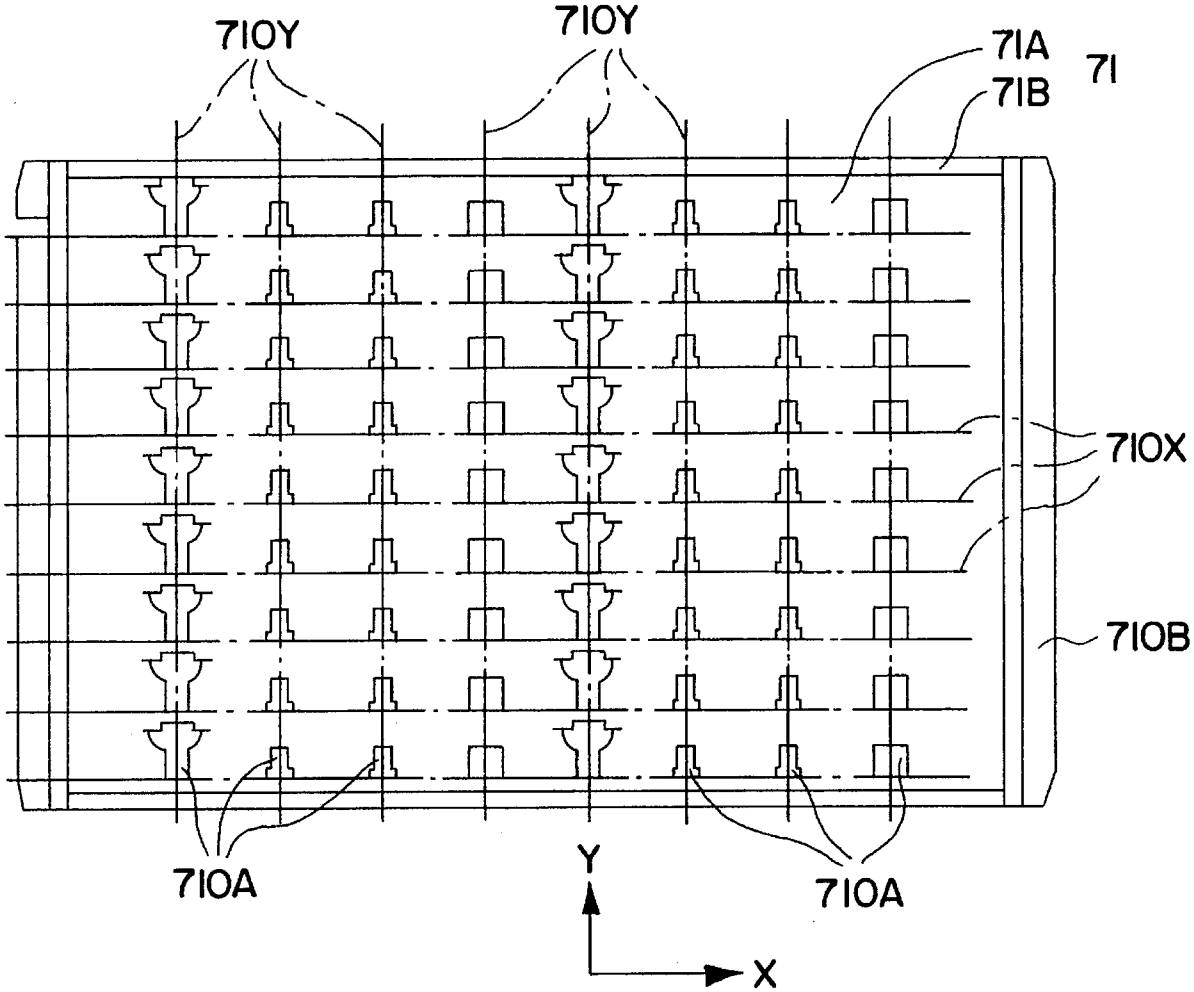
FIG. 4A is a front view of a pallet used in the producing apparatus.

As shown in FIGS. 4(A) and 4(B), each pallet 71 includes a plate member 71A for placing connector housings C and a frame 71B formed integrally with and around plate member 71A. Pallet 71 is adapted to arrange connector housings C necessary to fabricate one wire assembly in a row along the X-direction and is designed to prevent a supply error of supplying wrong parts and to accurately position connector housings C.

Plate member 71A is formed with a multitude of recesses 710A for accommodating connector housings C. Recesses 710A are formed such that the same connector housings C are positioned along center lines 710Y in parallel with the Y-direction, thus forming columns in the Y-direction of identical or similar connector housings on the pallet 71, and connector housings C necessary to build one wire assembly are positioned in a row along reference lines X in parallel with the X-direction.

Frame 71B is formed of, e.g., rigid polyvinyl chloride and is formed integrally with a guide flange 710B extending in the X-direction from opposite lateral sides of plate member 71A. Guide flange 710B acts as a guide member for moving pallet 71 in a specified direction.

As shown in FIG. 1, a multitude of pallet 71 are horizontally carried by pallet shelves 72. An operator O is enabled to arrange a variety of connector housings C in accordance with the determined layout of the pallet 71 behind the pallet shelves 72. Pallet shelves 72 carry a plurality of kinds of pallet 71 for positioning different kinds of connector housings. By replacing pallet 71, a different combination of connector housings C conforming to the kind of the wire assembly to be fabricated can be supplied.

In order to convey pallet 71 carrying connector housings C, a pallet transport unit 73 projecting in the Y-direction is provided before pallet shelves 72. Pallet transport unit 73 includes a pair of side walls 73*a* extending in the Y-direction and opposed to each other in the X-direction. A rail 73*b* (only one rail is illustrated) for carrying pallet 71 is secured at the upper end of the inner surface of each side wall 73*a*, so that pallet 71 is reciprocally movable on rails 73*b* in the Y-direction On one side wall 73*a* is mounted a driving device 75 for drawing specified pallet 71 from pallet shelves 72 and reciprocally moving the same. Pallet 71 is reciprocally moved by a claw 75*a* of driving device 75 as described above.

In the embodiment, pallet transport unit 73 is further provided with a connector positioning unit 76 at its front end. Positioning unit 76 is adapted to receive connector housings C to be supplied to holding plate A from actuators 74*a* to be described later and positioning the same at corresponding reference positions.

Figure 5:
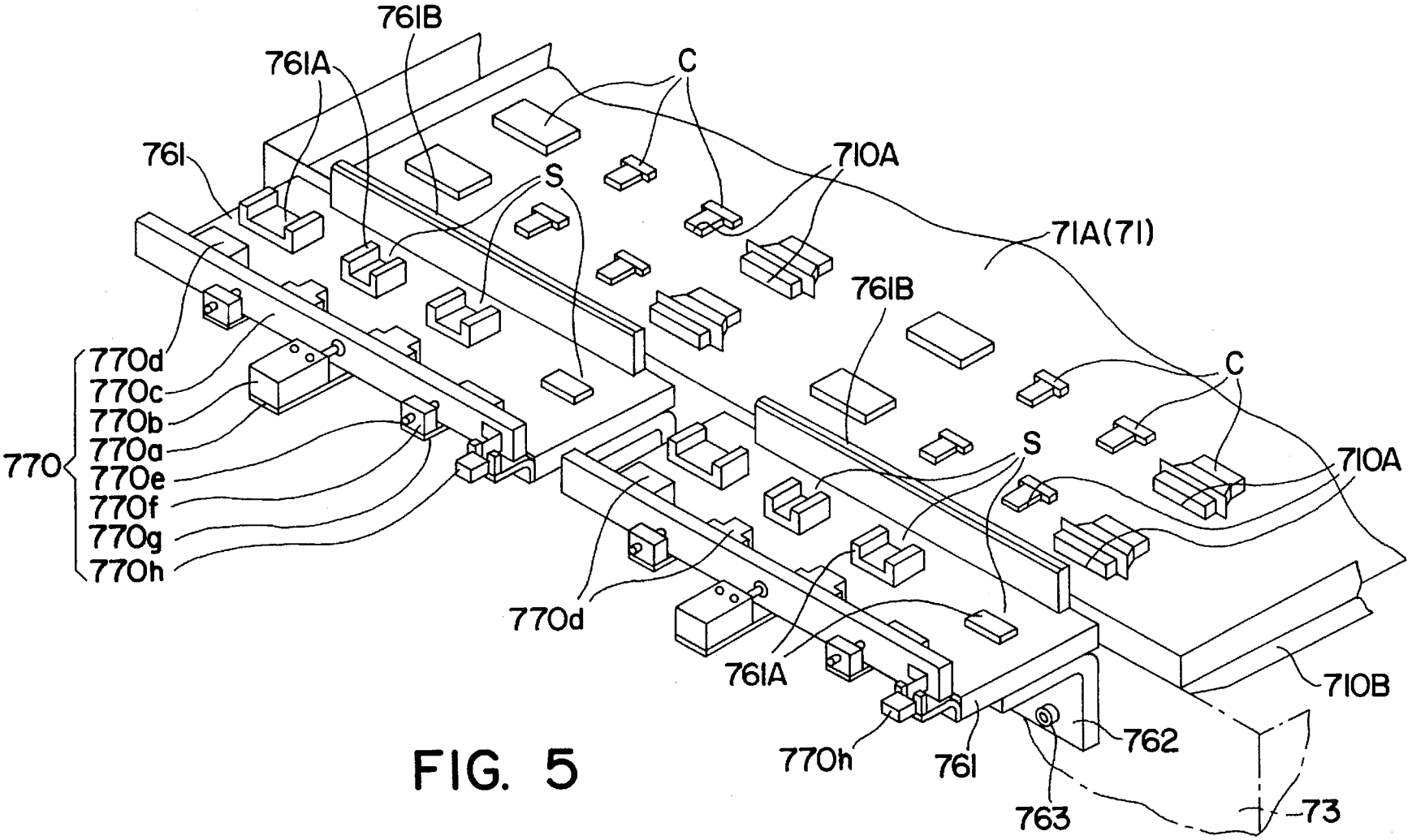
FIG. 5 is a schematic perspective view of an essential portion of the supplying device.

With reference to FIGS. 3 to 5, positioning unit 76 includes a pair of substrates 761. Each substrate 761 is secured to pallet transport unit 73 by means of an L-shaped angle fitting 762 and bolts 763. On the upper face of substrate 761 are secured level aligning members 761A for aligning the level of the plane on which connector housings C are placed. Level aligning members 761A are formed into a rectangular parallelepiped and a rectangular parallelepiped having a rectangular recess in the upper middle portion so that it has a Vertical cross-section of a C-shape opening upward such that individual connector housings C can be placed on the same level. A stroke restricting member 761B is secured on the rear end of the upper face of each substrate 761 (at the side opposite from the side facing holding plate A). Restricting member 761B is adapted to align terminal insertion openings C1 (see FIG. 3) of connector housings C placed on respective level aligning members 761A along the same vertical plane. Between restricting member 761B and each aligning member 761A is defined a holding space S (see FIG. 3) which allows actuator 74*a* to hold connector housing C. At the front end of each substrate 761 is provided a pressing mechanism 770 for pressing connector housings C placed on aligning members 761A against restricting member 761B.

Each pressing mechanism 770 includes a cylinder 770*b* secured on the front end (facing holding plate A) of substrate 761 by way of an L-shaped fitting 770*a*, a pressing plate 770*c* which is driven in the Y-direction by cylinder 770*b*, and pressers 770*d*which are secured on pressing plate 770*c* and opposed to connector housings C placed on level aligning members 761A. Guide shafts 770*e* projecting forward are fixed on pressing plate 770*c*. Each guide shaft 770*e* is slidably carried by a support member 770*f*. Support member 770*f* is secured on substrate 761 by way of a mount fitting 770*g*. In the embodiment, substrate 761 is also provided with a photodetector 770*h* for detecting the position of pressing plate 770*c* and outputting the detected position to a controller to be described later. Each presser 770*d* is formed to have shape and length in conformity with a corresponding connector housing C. Pressing mechanism 770 operates as follows. When connector housings C picked up from pallet 71 are placed on level aligning members 761A, cylinders 770*b* are driven and thereby pressers 770*d* press corresponding connector housings C against stroke restricting members 761B while the level thereof is aligned by level aligning members 761A. In this state, connector housings C are located at specified positions so that conveying unit 74 can easily hold them.

Conveying unit 74 is disposed above pallet transport unit 73 and is provided with a multitude of actuators 74*a* for holding individual connector housings C. Actuators 74*a* are secured and arranged on support 74*b* in the X-direction at such positions corresponding to respective columns of pallet 71. Actuators 74*a* are capable of holding a variety of connector housings C using air pressure or the like. Thus, actuators 74*a* can accurately hold connector housings C without making any adjustment even if pallet 71 is replaced and the kinds of connector housings C are changed.

Support 74*b* is movable upward and downward along a pillar 74*c* extending in the Z-direction. Pillar 74*c* is shiftable in the Y-direction along a beam 74*d*. Support 74*b*, pillar 74*c*, beam 74*d*, etc. enable actuators 74*a* to hold a row of connector housings on plate member 71A transported by pallet transport unit 73 at one time and convey them to wire connecting device M.

In FIG. 1, controller 100 includes a microcomputer, an input/output interface, a relay circuit and other wiring. Controller 100 controls the wiring assembly producing apparatus of this embodiment as follows.

First with reference to FIG. 1, wires W processed by winding 1, cutting device 2, peeling device 3, peeling detector 4, terminal cramping devices 5 and wire transfer device 6 are conveyed to wire connecting device M by terminal inserting device Simultaneously with the processing operation of wires W, housing supplying device 7 transports a pallet 71 carrying connector housings C toward wire connecting device M in the Y-direction. Upon receipt of pallet 71, conveying unit 74 operates and actuators 74*a* hold corresponding connector housings C with one stroke. With reference to FIG. 3, connector housings C held by actuators 74*a* are temporarily placed on level aligning members 761A of positioning unit 76 and terminal insertion openings C1 of connector housings C face stroke restricting members 761B. In this state, connector housings C are pressed against stroke restricting members 761B by corresponding pressers 770*d* and-are fixedly positioned while being placed on the same level.

When connector housings C are positioned, actuators 74*a* hold corresponding connector housings C again. Thereafter, pressing mechanism 770 is driven again, thereby releasing connector housings C held by actuators 74*a*. Thus, connector housings C can be conveyed to holding plate A by actuators 74*a* while being kept accurately positioned.

Subsequently, conveying unit 74 causes actuators 74*a* to integrally convey connector housings C to holding plate A by way of support 74*b*, pillar 74*c* and beam 74*d*. Actuators 74*a* place connector housings C on one plate member A1 of holding plate A and insert them into insertion openings A3. As described above, the bottom surfaces of connector housings C are aligned to have the same reference level by level aligning members 761A in this embodiment. Since connector housings C are placed on the plate member A1 and inserted into insertion openings A3 in this state, different kinds of connector housings C can be conveyed at one time while being kept accurately positioned.

Particularly, when connector housings C are positioned to have the same reference level on the basis of terminal insertion openings C1 which are highly accurately dimensioned as in this embodiment, they can be most accurately positioned.

After actuators 74*a* complete the insertion of connector housings C into insertion openings A3, cylinders A5 drive locking gadgets A4 to lock connector housings C in insertion openings A3, thereby finishing the supply of connector housings C to a holding plate A of housing holding device 9.

When connector housings C are fixed, mount member 91 is driven to rotate by 180° by driving device 93,. with the result that connector housings C face terminal inserting mechanism 8. After the rotation, mount member 91 is fixed and positioned by the unillustrated knock pins. Consequently, head 82 of terminal inserting device 8 moves to thereby insert terminals T into corresponding predetermined connector housings C.

In this embodiment, connector housings c to be supplied are arranged on pallet 71 in a plurality of rows in correspondence with the side-by-side alignments of insertion openings A3 of holding plate A. Arranged connector housings C are held by actuators 74*a* while the alignment thereof is maintained. Connector housings C held by actuators 74*a* are conveyed to holding plate A by means of support 74*b*, pillar 74*c*, beam 74*d*, etc. as a conveying means while the side-by-side alignment thereof is maintained.

Since connector housings C arranged side-by-side on pallet 71 are held and conveyed by actuators 74*a* in this embodiment, only pallet 71 is replaced without making any change in conveying unit 74 in changing the combination of connector housings C to be handled. Accordingly, remarkable effects can be obtained: conveying unit 74 can be widely used for a variety of connector housings, and labor and time required for replacement can be reduced. Employment of pallet 71 for Arranging connector housings C side-by-side in a plurality of rows facilitates conveyance of connector housings C by means of actuators 74*a*. As a result, installation can be of smaller size compared to prior art guide members for guiding connector housings C in sliding contact therewith, leading to a considerable reduction in installation cost.

Particularly in this embodiment, connector housings C are positioned to have the same reference level by connector positioning unit 76 before being conveyed by actuators 74*a* of conveying unit 74. Thus, connector housings C having different sizes can be advantageously held and conveyed at one time in accordance with their individually set levels of the bottom surfaces and insertion strokes.

The foregoing embodiment is nothing but an illustration of the preferred embodiment of the invention and the invention is not limited thereto. It is understood that various changes and modifications may be made in the specific embodiment of the invention without departing from the spirit and scope as set out in the accompanying claims. For instance, the device for connecting wires with cramping terminals may be installed side by side with the supplying unit and conveying unit of the invention.

What is claimed is:

1. A connector housing supplying device, comprising:

at least one pallet for arraying a plurality of connector housings in a plurality of rows and a plurality of columns;

at least one holding plate having a plurality of fixtures disposed for alignment with the respective columns of the pallet, a plurality of actuators disposed for alignment with the respective columns, said actuators being simultaneously operable for engaging the connector housings in one said row and for subsequently releasing the engaged connector housings; and a conveying apparatus for moving said actuators between a position in proximity to at least one said row on said pallet and a position in proximity to the holding plate, whereby the conveying apparatus enables the actuators to simultaneously remove one said row of the connector housings from the pallet and subsequently enables the actuators to simultaneously deposit the engaged connector housings onto the fixtures of the holding plate.

2. The device of claim 1, wherein each said connector housing has a shape, the shapes of the connector housings in each said column on said pallet being identical to one another.

3. The device of claim 2, wherein the shapes of the connector housings in at least one said column on said pallet are different from the shapes of the connector housings in at least one other of said columns on said pallet.

4. The device of claim 3, further comprising a positioning unit having a plurality of aligning members disposed for alignment with the respective columns, said aligning members defining a plurality of different shapes corresponding respectively to the shapes of the respective connector housings in the columns with which the respective aligning member is aligned, said conveying apparatus and said actuators being operative to move said connector housings from said pallet to said positioning unit before moving said connector housings to said holding plate, whereby said actuators release said connector housings onto said aligning members and reengage the connector housings at positions determined by the shape of the respective aligning member.

5. The device of claim 4, further comprising a restricting member on said positioning unit in proximity to said aligning members, and a pressing plate on said positioning unit such that said aligning members of said positioning unit are intermediate said restricting member and said pressing plate, and at least one cylinder for urging said pressing plate toward said aligning members for urging said connector housings into said restricting member and achieving a specified alignment of said connector housings on said positioning unit.

6. The device of claim 5, further comprising at least one presser mounted on said pressing plate for alignment with a corresponding one of said aligning members, said presser having dimensions selected for controlling the movement of the connector housing in the corresponding aligning member in response to movement of the pressing plate.

7. The device of claim 1, further comprising locks for selectively and releasably locking the connector housings in the fixtures of the holding plate.

8. The device of claim 1, wherein the plurality of fixtures on the holding plate define a first array of fixtures, and wherein the holding plate further comprises a second array of fixtures spaced from the first array and disposed respectively for alignment with the columns of the pallet, said actuators being operative to altemately place connector housings on the fixtures of the first and second arrays.

9. The device of claim 8, wherein the holding plate is selectively moveable for alternately placing said first and second arrays of fixtures in a location for receiving connector housings from the actuators.

10. The device of claim 1, wherein said at least one pallet comprises a plurality of pallets, and wherein said device further comprises means for storing said plurality of pallets and a pallet transport unit for selectively and sequentially moving pallets from said storage means into a position where the connector housings on the respective pallet are accessible to the actuators.

11. The device of claim 1, further comprising inserting means in proximity to said holding device for holding a plurality of terminals at locations substantially aligned with the connector housings on the holding plate and for inserting said terminals into said connector housings on said holding plate.

* * * * *